US005299110A

United States Patent [19]

Lin

[11] Patent Number: 5,299,110

[45] Date of Patent: Mar. 29, 1994

[54] FLUORESCENT LAMP ASSEMBLY

[76] Inventor: Lee-Mao Lin, 154, Hsin-Hsing Rd., Hsiao-Tung Li, I-Lan City, Taiwan

[21] Appl. No.: 992,737

[22] Filed: Dec. 18, 1992

[51] Int. Cl.[5] ..... F21V 1/12

[52] U.S. Cl. ..... 362/260; 362/416; 362/84; 362/390; 313/50; 313/484; 313/623

[58] Field of Search ..... 362/260, 416, 84, 390; 313/569, 623, 573, 574, 484, 578, 601, 595, 608, 631, 283, 284, 50

[56] References Cited

U.S. PATENT DOCUMENTS

| | | | |
|---|---|---|---|
| 2,308,986 | 1/1943 | Livers | 362/260 |
| 2,337,745 | 12/1943 | Garstang | 362/260 |
| 4,322,783 | 3/1982 | Chappell et al. | 362/416 X |
| 4,727,459 | 2/1988 | Palumbo | 362/260 |
| 4,963,785 | 10/1990 | Takagi et al. | 362/416 |

*Primary Examiner*—Larry Jones

*Attorney, Agent, or Firm*—Bacon & Thomas

[57] ABSTRACT

An improved fluorescent lamp is provided with two conductive poles formed at two ends of the lamp. Each conductive pole is contained in a the the lamp tube and includes a a extending contact pin perpendicularly from a conductive pole and extending outwardly from the end portion of the lamp for associating with a contact socket. In start operation, a voltage is supplied to the conductive pole via the contact pin and the contact socket to ionize and start the lamp. The socket is composed of an end cover, a contact plate, and a spring positioned between the end cover and the contact plate, so that the contact pin of the fluorescent lamp may securely engage with the contact socket. The contact plate of the socket further has a concave portion formed at its central portion to securely receive the contact pin of the lamp.

1 Claim, 4 Drawing Sheets

FLUORESCENT LAMP ASSEMBLY

BACKGROUND OF THE INVENTION

The present invention relates to an improved fluorescent lamp, and more particularly to a fluorescent lamp having a structure of two unitary conductive poles formed at two ends of the lamp tube respectively.

The well-known fluorescent lamp has various electrical power types of 10W, 20W, 40W and so on. In general, the conventional fluorescent lamp is designed to have shape of tube type, U-shaped type, or circular type. Typically, the fluorescent lamp has a pair of bi-pin filaments contained at each of the two ends of the lamp tube of the fluorescent lamp. Each of the filaments is led to the outer end point of the lamp, serving as a contact pin for connecting outer electrical power leads. That is, there are four contact pins in total and symmetrically formed at the two ends of the lamp tube. In order to start the lamp, it is necessary to first preheat the filament of the lamp by means of a starter, and then it is possible to ionize the inner gas in the lamp tube. Such a theory and the start operation of the fluorescent lamp has never changed since the fluorescent lamp was invented.

It is found that the conventional fluorescent lamp has disadvantages as follows:

1. During the pre-heating time of the lamp, the pre-heating current flowing through the filament is rather high and therefore the lamp consumes a large amount of electrical power. Further, the conventional fluorescent lamp needs a rather long pre-heating time to accomplish the start operation.

2. Because the initial current of the filament is relatively high during the start operation, the filament of the lamp is easy burned out or broken. Once the filament is broken, the fluorescent lamp will be useless.

3. The conventional fluorescent lamp must be provided with a starter to start the lamp by means of the starter. However, the starter often does not work normally due to faulty conditions. In such case, the starter must be replaced for maintaining the normal function of the start operation.

4. The lamp has in total four contact pins at two ends of the lamp. The possibility of faulty condition such as improper contact is relatively high because of more contact pins.

5. The fluorescent material in the lamp tube will be exhausted quickly during pre-heating period of the filament of the lamp.

6. The instant starting current of the lamp is rather large.

7. The starting time of the lamp is typically about 5 seconds. Obviously, in order to accomplish the start operation of the lamp, it will take much time.

SUMMARY OF THE INVENTION

In view of the drawbacks of the prior art mentioned above, the primary object of the present invention is to provide an improved fluorescent lamp. In the preferred embodiment of the present invention, there is provided two conductive poles formed at the two ends of the lamp, serving as function of a coil-shaped filament of the conventional fluorescent lamp. Each of the conductive poles has a unitary contact pin perpendicularly formed on the conductive pole. The contact pin extends from the end portion of the lamp tube for contacting an outer power lead or socket.

The other object of the present invention is to provide an improved fluorescent lamp without using a conventional starter, and therefore it is possible to start the lamp without pre-heating the filament. Furthermore, the instant starting current of the filament may be reduced to a relative low current level.

The other objects and features of the invention will become more apparent from the following description taken in connection with the accompanying drawings.

DETAILED DESCRIPTION OF THE INVENTION

Figure 1A:
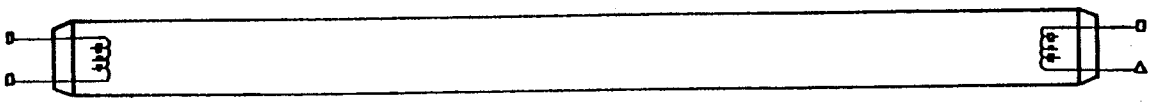
PRIOR ART FIG. 1A
FIG. 1A is a plan view illustrating a tube type fluorescent lamp of the prior art.
Figure 1B:
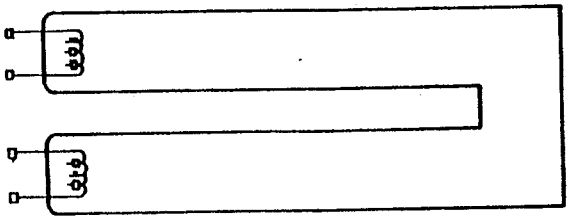
PRIOR ART FIG. 1B
FIG. 1B is a plan view illustrating a U-shaped fluorescent lamp of the prior art.

Referring now to FIGS. 1A and 1B, where FIG. 1A illustrates the plan view of the typical tube type fluorescent lamp, while FIG. 1B illustrates the plan view of the U-shaped fluorescent lamp. Both the two conventional fluorescent lamps above are provided with two filaments respectively formed at each of two ends of the lamp tube, and generally provided with bi-pin contacts for serving as contact pins. In such a manner, the lamp tube may be plugged into a socket of the lamp set.

Figure 2A:
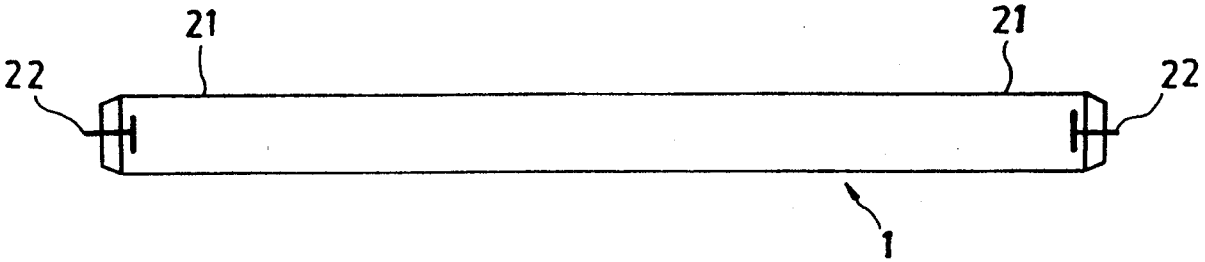
FIG. 2A illustrating the structure of the tube type fluorescent lamp of the present invention.
Figure 2B:
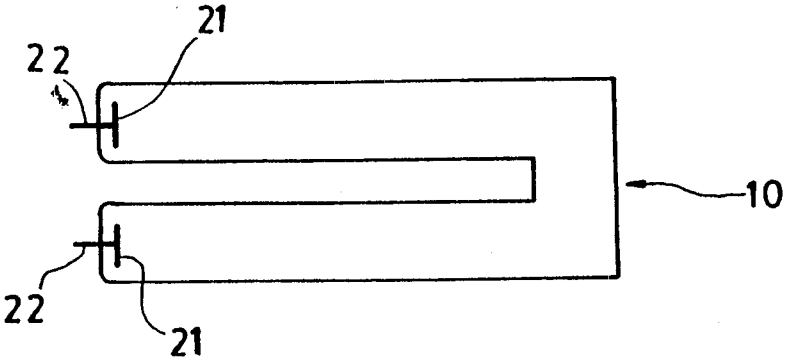
FIG. 2B illustrating the structure of the U-shaped fluorescent lamp of the present invention.

FIGS. 2A and 2B respectively show the tube type and U-shaped 10 fluorescent tubes of the present invention. The two ends of the fluorescent lamp of this invention are each provided with a conductive pole 21, and each conductive pole 21 has a contact pin 22 extending from the conductive pole. In the structure of the present invention, the conductive poles at the two ends of the fluorescent lamp form a positive pole and negative pole. So, the fluorescent lamp may be called a two pole type fluorescent lamp.

When a power source is supplied to the two conductive poles of the lamp, it will cause an initial heating of the filaments of the lamp prior to ionizing the lamp, and finally start the lamp. The start procedures above may be achieved by employing a conventional start circuit. The start theory of the fluorescent lamp will be briefly described below. In general, an AC voltage is supplied to a switch unit and an amplifying circuit to cause a transformer to generate an output signal on the second coil of the transformer. The output signal of the second coil of the transformer will be rectified and then sent to a high frequency amplifier. The filaments contained at two ends of the lamp are connected to the output of the high frequency amplifier, so that the high frequency signal may ionize the lamp and finally start the lamp. The control sequence of the control circuit briefly described above do not form part of the present invention, so that the detailed circuit arrangement of the control circuit need not be further illustrated.

The start operation of the present invention does not require a starter as in the case of a conventional fluorescent lamp. Therefore, the start time is relatively faster than that of the prior art and has the advantage of saving electrical power.

Figure 3:
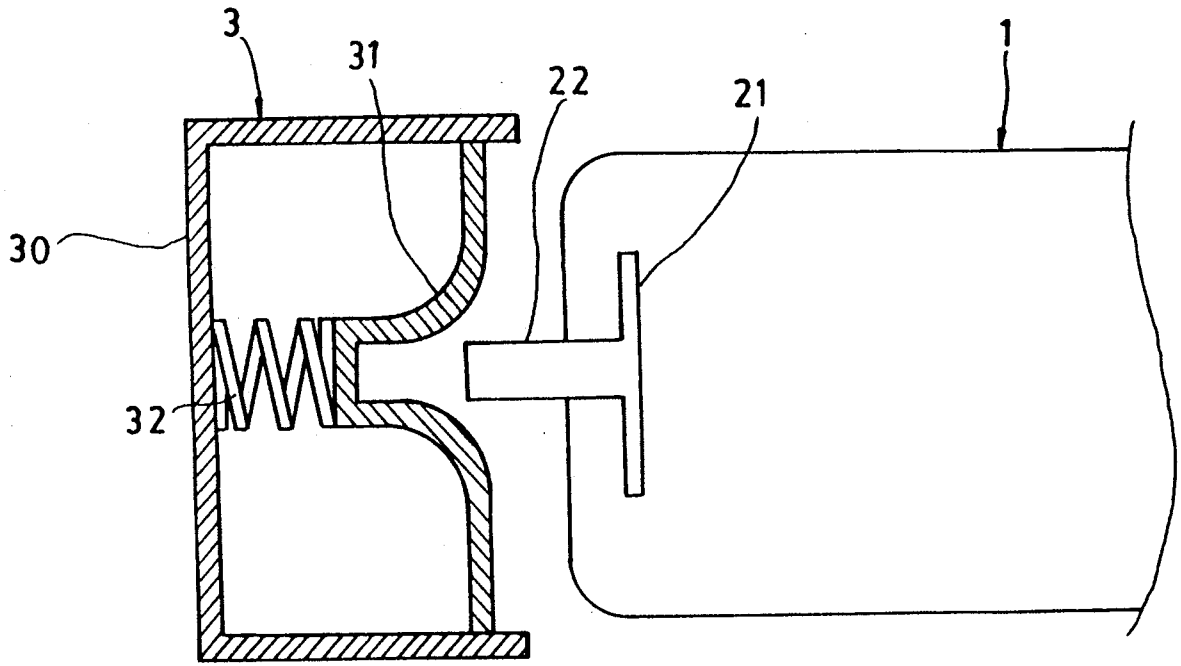
FIG. 3 is a plan view showing the end portion of the lamp, which may be associated with a socket in accordance with the present invention.

FIG. 3 shows the detailed structure of the end portion of the fluorescent lamp of the present invention in more detail. The lamp may be associated with a contact socket. As described above, the lamp tube 10 at its end portion is provided with a conductive pole 21 and a unitary contact pin 22 perpendicularly formed on the conductive pole 21. The end portion of the lamp may engage with a contact socket 3, as shown in FIG. 3, to form an electrical contact. The contact socket 3 is composed of a contact plate 31, an end cover 30, and a spring 32 positioned between the contact plate 31 and the end cover 30. The contact plate 31 is contained in the cover 30 and supported by the spring 32. In such an arrangement, the contact plate 31 may be tightly urged into contact with the contact pin 22 of the lamp by the force of the spring 32 when the lamp is plugged into the contact socket 3.

The contact plate 31 is designed to have a smooth concave contact area formed on the central portion thereof. Thus, the contact pole 22 may easily engage the contact plate 31. Furthermore, the spring force provided by the spring 32 may ensure the preferred contact between the contact plate 31 of the socket 3 and the contact pin 22.

Figure 4B:
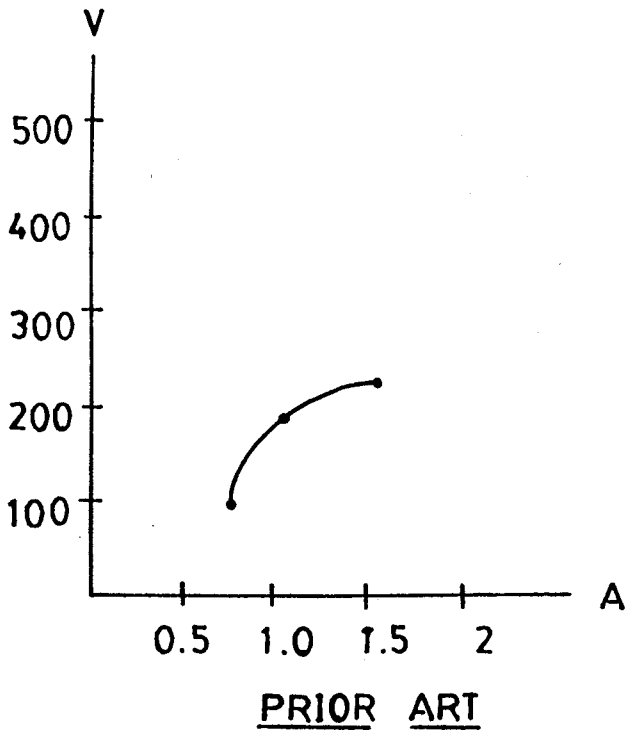
PRIOR ART FIG. 4B
FIG. 4B shows the characteristic curve of the voltage and current of the lamp of the prior art.
Figure 4A:
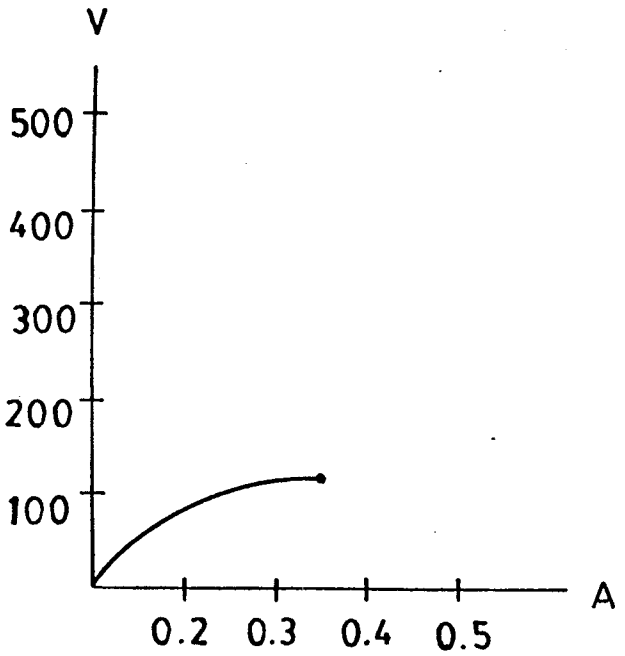
FIG. 4A shows the characteristic curve of the voltage and current of the lamp according to the present invention.

FIG. 4A shows the characteristic curve of the voltage and current of the lamp according to the present invention, in which the symbol A represents the amount of current and the symbol V represents the amount of voltage. FIG. 4B shows the characteristic curve of the voltage and current of the lamp of the prior art. Comparing with the characteristic curve shown in FIG. 4A and FIG. 4B, it is obviously that the effect of the present invention is superior to that of the prior art. It is found that the present invention has advantages, including the fact that it is not necessary to use any starter to start the lamp. As to the power consumption of the lamp, it is found that the present invention may save a large amount of electrical power, about 30 to 50%, compared with the prior art.

So far, the feature of the present invention has been described in detail. It will be obvious to those skilled in the art to use this invention according to the above detailed description. While the arrangement herein described constitutes a preferred embodiment of this invention, it is to be understood that various changes and modifications may be made therein without departing from the scope and spirit of the invention as defined in the appended claim.

I claim:

1. A fluorescent lamp assembly comprising:

a) a fluorescent lamp tube including a pair of opposite end portions;

b) a positive conductive pole at one end portion and a negative conductive pole at the other end portion, each conductive pole including a single perpendicular contact pin extending outwardly from the end portion of the lamp tube; and c) a contact socket for providing electrical connection between each conductive pole and an electric power source, the contact socket including an end cover, a contact plate disposed within the end cover and provided with a central concave portion for engagement by the contact pin, and a spring positioned between the end cover and the contact plate for urging the contact plate into secure engagement with the contact pin.

* * * * *